US008115165B2

(12) United States Patent
Thomson

(10) Patent No.: US 8,115,165 B2
(45) Date of Patent: Feb. 14, 2012

(54) MASS SELECTOR

(75) Inventor: Bruce Thomson, Toronto (CA)

(73) Assignee: DH Technologies Development Pte. Ltd., Singapore (SG)

( * ) Notice: Subject to any disclaimer, the term of this patent is extended or adjusted under 35 U.S.C. 154(b) by 76 days.

(21) Appl. No.: 12/788,391

(22) Filed: May 27, 2010

(65) Prior Publication Data

US 2011/0127418 A1 Jun. 2, 2011

Related U.S. Application Data

(60) Provisional application No. 61/181,399, filed on May 27, 2009.

(51) Int. Cl.
*H01J 49/06* (2006.01)
*H01J 49/26* (2006.01)

(52) U.S. Cl. ..... 250/281; 250/282

(58) Field of Classification Search ..... None
See application file for complete search history.

(56) References Cited

U.S. PATENT DOCUMENTS 5,880,466 A 3/1999 Benner
6,744,042 B2 6/2004 Zajfman et al.
6,888,130 B1 5/2005 Gonin
2007/0176090 A1 8/2007 Verentchikov
2009/0206248 A1 8/2009 Makarov et al.
2010/0084549 A1 * 4/2010 Ermakov et al. ..... 250/283

OTHER PUBLICATIONS

PCT International Application No. PCT/CA2010/000798 Search Report dated Jul. 29, 2010; Authorized Officer: Humberto Castaneda.
PCT International Application No. PCT/CA2010/000798 Written Opinion dated Jul. 29, 2010; Authorized Officer: Humberto Castaneda.

* cited by examiner

*Primary Examiner* — Jack Berman

(57) ABSTRACT

A mass spectrometer and method for performing high resolution mass spectrometry are provided, the mass spectrometer comprising an electrostatic trap and mass analyzer. The electrostatic trap comprises entrance and exit ends, entrance and exit end ion mirrors, a central field-free region, and a longitudinal axis. The mass analyzer receives ions from the exit end. Ions are admitted into the electrostatic trap via the entrance end, trapping ions in the electrostatic trap, the ions oscillating between the entrance and exit end ion mirrors along the axis. The electrostatic trap waits for the ions to separate into bunches different m/z values via the oscillating, and then excites a given bunch of ions of a given m/z value along the axis until at least a portion of the given bunch overcomes a barrier field at the exit end ion mirror, exiting the electrostatic trap for analysis, leaving behind remaining ions.

18 Claims, 5 Drawing Sheets

MASS SELECTOR

FIELD

The specification relates generally to mass spectrometers and specifically to a mass spectrometer and method for performing high resolution mass spectrometry.

BACKGROUND

In conventional mass spectrometer systems, it is challenging to achieve high mass resolution of a precursor ion for MS/MS. While electrostatic traps have been used to achieve high mass resolution, this is done at the expense of first exciting ions within the trap and then ejecting ions that are not of interest, until only ions of interest remain. The remaining ions of interest can be subsequently ejected from the electrostatic trap, fragmented and analyzed. If it is desired to analyze other ions, the electrostatic trap must be refilled and other ions of interested selected in a similar manner. While these techniques can achieve high mass resolution, they are generally very wasteful of sample, which can often be available in limited quantities.

SUMMARY

A first aspect of the present specification provides a method of operating a mass spectrometer. The mass spectrometer comprises an electrostatic trap and a mass analyzer. The electrostatic trap comprises an entrance end, an exit end, an entrance end ion mirror and an exit end ion mirror, a central field-free region, and a longitudinal axis. The mass analyzer is enabled to receive ions from the exit end. The method comprises admitting ions into the electrostatic trap via the entrance end. The method further comprises trapping ions in the electrostatic trap, the ions oscillating between the entrance end ion mirror and the exit end ion mirror along the longitudinal axis. The method further comprises waiting for the ions to separate into bunches of ions of different m/z values via the oscillating. The method further comprises exciting a given bunch of ions of a given m/z value along the longitudinal axis until at least a portion of the given bunch overcomes a barrier field at the exit end ion mirror, thereby exiting the electrostatic trap, leaving behind remaining ions in the electrostatic trap. The method further comprises analyzing at least a portion of the given bunch via the mass analyzer.

Exciting the subset of the ions can comprise applying an oscillating electric field along the longitudinal axis in phase with an oscillation of the given bunch along the longitudinal axis. The oscillating electric field can be applied between a pair of at least one of ring electrodes, grid electrodes and aperture containing plate electrodes, located in the central field-free region. The oscillating electric field can be applied in at least one of the entrance end ion mirror and the exit end ion mirror.

The method can further comprise compensating each of the entrance end ion mirror and the exit end ion mirror to maintain timing and phase of the oscillating during the exciting.

The method can further comprise fragmenting at least a portion of the given bunch in a fragmentation module prior to the analyzing. The method can further comprise decelerating the given bunch prior to the fragmenting. Decelerating can occur via at least one of a decelerating lens, a decelerating electric field, and an ion focussing field.

The method can further comprise: exciting a second given bunch of the remaining ions of a second given m/z value along the longitudinal axis until at least a portion of the second given bunch overcomes the barrier field at the exit end ion mirror, thereby exiting the electrostatic trap, leaving behind further remaining ions in the electrostatic trap; and analyzing at least a portion of the second given bunch via the mass analyzer.

A second aspect of the specification provides a mass spectrometer. The mass spectrometer comprises an electrostatic trap and a mass analyzer. The electrostatic trap comprises an entrance end, an exit end, an entrance end ion mirror and an exit end ion mirror, a central field-free region, and a longitudinal axis. The electrostatic trap is enabled to: admit ions therein via the entrance end; trap ions therein such that the ions oscillate between the entrance end ion mirror and the exit end ion mirror along the longitudinal axis; wait for the ions to separate into bunches of ions of different m/z values via the oscillating; and excite a given bunch of ions of a given m/z value along the longitudinal axis until at least a portion of the given bunch overcomes a barrier field at the exit end ion mirror, thereby exiting the electrostatic trap, leaving behind remaining ions in the electrostatic trap. The mass analyzer is enabled to receive ions from the exit end and analyze at least a portion of the given bunch.

To excite the subset of the ions, the electrostatic trap is further enabled to apply an oscillating electric field along the longitudinal axis in phase with an oscillation of the given bunch along the longitudinal axis. The electrostatic trap can further comprise a pair of at least one of ring electrodes, grid electrodes and aperture containing plate electrodes located in the central field-free region, the oscillating electric field applied there between. The electrostatic trap further can be further enabled to apply the oscillating electric field in at least one of the entrance end ion mirror and the exit end ion mirror.

The electrostatic trap further can be further enabled to compensate each of the entrance end ion mirror and the exit end ion mirror to maintain timing and phase of the oscillating when the given bunch of ions is excited The mass spectrometer can further comprise a fragmentation module enabled to fragment at least a portion of the given bunch prior to the given bunch being analyzes at the mass analyzer. The mass spectrometer can be further enabled to decelerate the given bunch prior to fragmenting the given bunch. The mass spectrometer can further comprise at least one of a decelerating lens, a decelerating electric field apparatus, and an ion focussing field apparatus for decelerating the given bunch prior to the fragmenting the given bunch.

The electrostatic trap can be further enabled to: excite a second given bunch of the remaining ions of a second given m/z value along the longitudinal axis until at least a portion of the second given bunch overcomes the barrier field at the exit end ion mirror, thereby exiting the electrostatic trap, leaving behind further remaining ions in the electrostatic trap at least a portion of the second given bunch analyzed via the mass analyzer.

BRIEF DESCRIPTIONS OF THE DRAWINGS

Embodiments are described with reference to the following figures, in which.

DETAILED DESCRIPTION OF THE EMBODIMENTS

Figure 1:
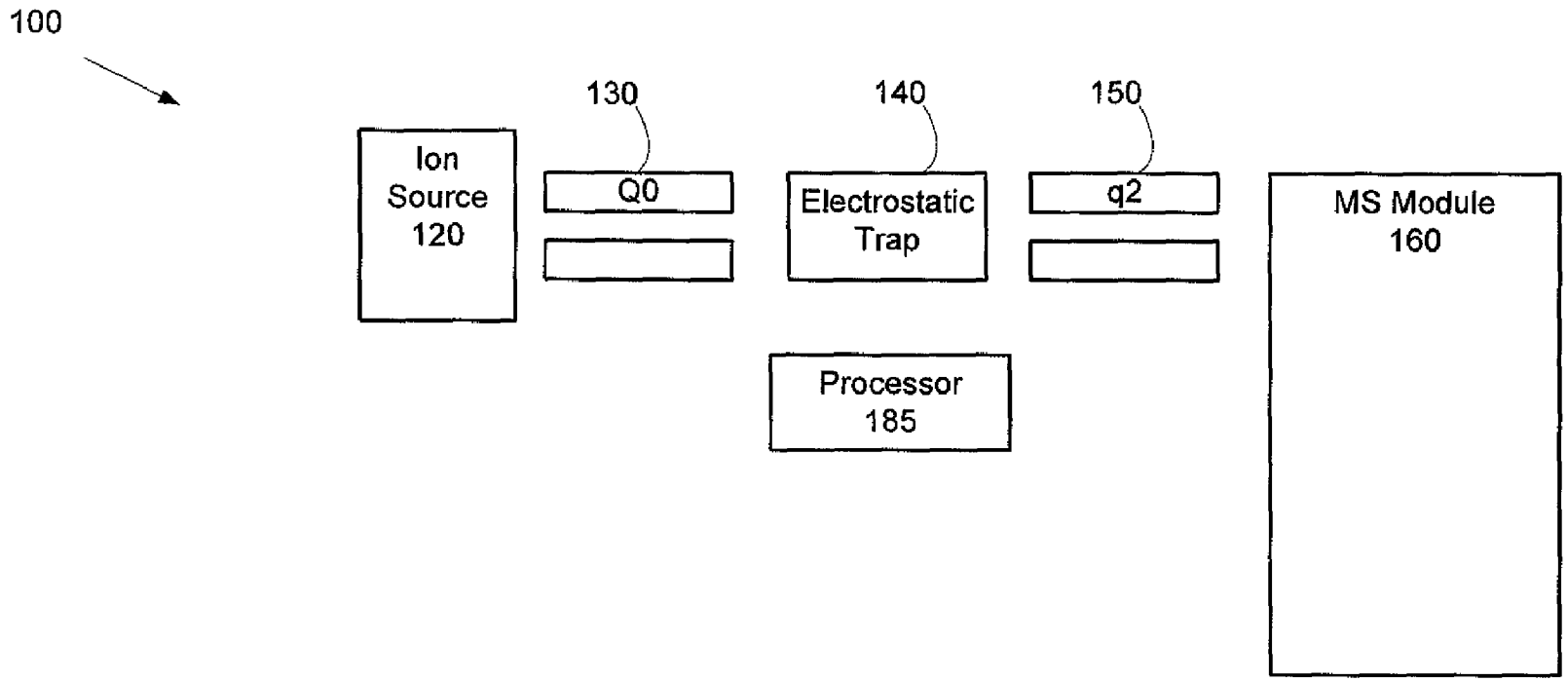
FIG. 1 depicts a block diagram of a mass spectrometer for performing high resolution mass spectrometry, according to non-limiting embodiments.

FIG. 1 depicts a block diagram of a mass spectrometer 100 for performing high resolution mass spectrometry, according to non-limiting embodiments. Mass spectrometer 100 generally comprises an ion source 120, ion optics 130, an electrostatic trap (EST) 140, a fragmentation module 150 and a mass analyzer 160, which are generally arranged such that ions produced at ion source 120 can be transferred to mass analyzer 160 for analysis. In some embodiments, mass spectrometer 100 can further comprise a processor 185 for controlling operation of mass spectrometer 100, including but not limited to controlling ion source 120 to ionise the ionisable materials, and controlling transfer of ions between modules of mass spectrometer 100. In particular, processor 185 controls EST 140, as described below.

In operation, ionisable materials are introduced into ion source 120. Ion source 120 generally ionises the ionisable materials to produce precursor ions which are transferred to ion optics 130 (also identified as Q0, indicative that ion optics 130 take no part in the mass analysis). Precursor ions are transferred from ion optics 130 to EST 140 which selectively and sequentially filters precursor ions, in a manner described below. Selected precursor ions can then be transferred to fragmentation module 150 (also identified as q2) for fragmentation, to form respective product ions. Product ions are subsequently transferred to mass analyzer 160 for mass analysis, resulting in production of product ion spectra.

Furthermore, while not depicted, mass spectrometer 100 can comprise any suitable number of vacuum pumps to provide a suitable vacuum in ion source 120, ion optics 130, EST 140, fragmentation module 150 and/or mass analyzer 160. It is understood that in some embodiments a vacuum differential can be created between certain elements of mass spectrometer 100: for example a vacuum differential is generally applied between ion source 120 and ion optics 130, such that ion source 120 is at atmospheric pressure and ion optics 130 are under vacuum. While also not depicted, mass spectrometer 100 can further comprise any suitable number of connectors, power sources, RF (radio-frequency) power sources, DC (direct current) power sources, gas sources (e.g. for ion source 120 and/or fragmentation module 150), and any other suitable components for enabling operation of mass spectrometer 100.

Ion source 120 comprises any suitable ion source for ionising ionisable materials. Ion source 120 can include, but is not limited to, an electrospray ion source, an ion spray ion source, a corona discharge device, and the like. In these embodiments, ion source 120 can be connected to a mass separation system (not depicted), such as a liquid chromatography system, enabled to dispense (e.g. elute) ionisable to ion source 120 in any suitable manner.

In specific non-limiting embodiments, ion source 120 can comprise a matrix-assisted laser desorption/ionisation (MALDI) ion source, and samples of ionisable materials are first dispensed onto a MALDI plate, which can generally comprise a translation stage. Correspondingly, ion source 120 is enabled to receive the ionisable materials via the MALDI plate, which can be inserted into the MALDI ion source, and ionise the samples of ionisable materials in any suitable order. In these embodiments, any suitable number of MALDI plates with any suitable number of samples dispensed there upon can be prepared prior to inserting them into the MALDI ion source.

Precursor ions produced at ion source 120 are transferred to ion optics 130, for example via a vacuum differential and/or a suitable electric field(s). Ion optics 130 can generally comprise any suitable multipole including, but limited to, a quadrupole rod set. Ion optics 130 are generally enabled to cool and focus precursor ions, and can further serve as an interface between ion source 120, at atmospheric pressure, and subsequent lower pressure vacuum modules of mass spectrometer 100.

Precursor ions are then transferred to EST 140, for example via any suitable vacuum differential and/or a suitable electric field(s), EST 140 enabled to selectively and sequentially filter ions, which are transferred to fragmentation module 150.

Figure 2:
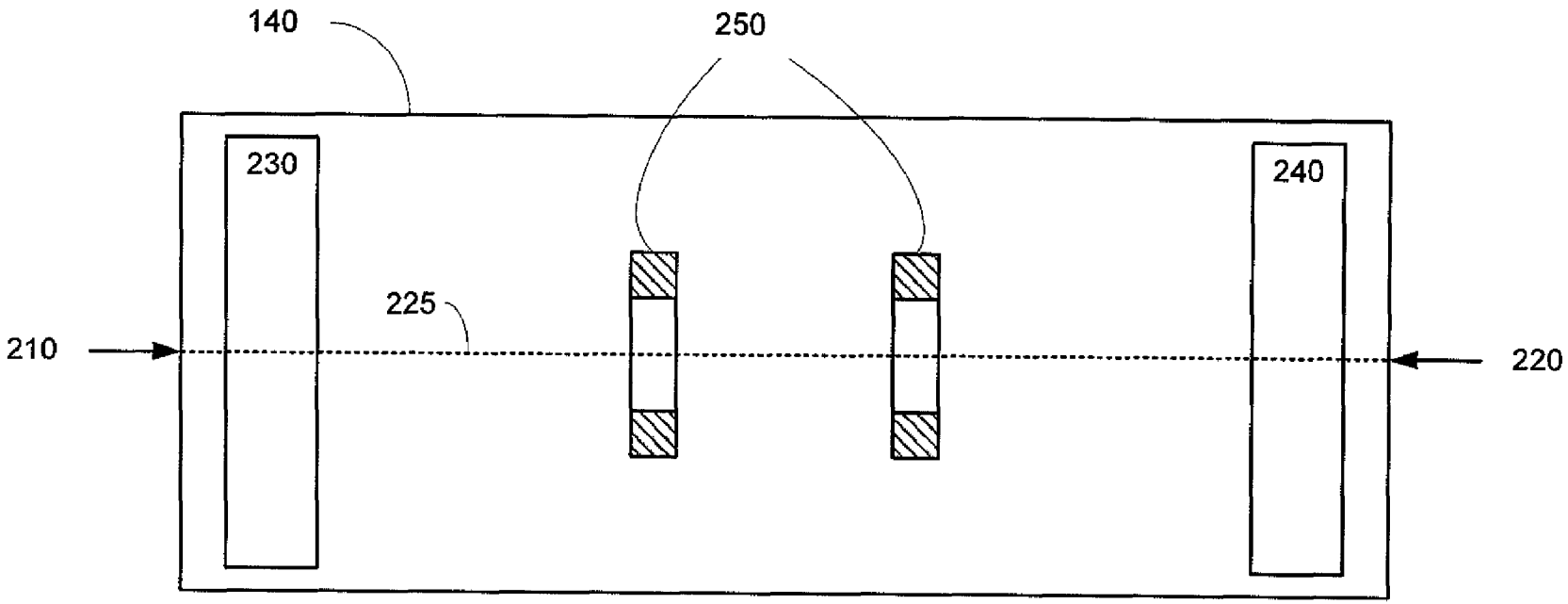
FIG. 2 depicts an electrostatic trap, according to non-limiting embodiments.

Attention is now directed to FIG. 2, which depicts a block diagram of EST 140, according to non-limiting embodiments. EST 140 comprises an entrance end 210 and an exit end 220. Entrance end 210 is generally enabled to accept ions from ion optics 130 such that EST 140 can be filled with ions. Furthermore, exit end 220 is generally enabled to allow ions to exit from EST 140 such that ions can be transferred to fragmentation chamber 150. In general, ions travel along and/or parallel to a longitudinal axis 225. EST 140 further comprises an entrance end ion mirror 230, proximate entrance end 210, and an exit end ion mirror 240, proximate exit end 230. Each ion mirror 230, 240 is enabled to use a static electric field to reverse the direction of travel of ions entering it, and further comprises a barrier field that retains ions within EST 140. Hence, ions admitted into EST 140 via entrance end 210 are trapped within EST 140, the ions oscillating between entrance end ion mirror 230 and exit end ion mirror 240 along longitudinal axis 225.

EST 140 further comprises electrodes 250, which can comprise, in some non-limiting embodiments, a pair of ring electrodes, depicted in cross-section in FIG. 2. In other embodiments, electrodes 250 can include, but are not limited to, a pair of grids and a pair of plates containing apertures. In general, electrodes 250 can be located in a central nominally field free region of EST 140, approximately equidistant between ion mirrors 230, 240. It is understood, however, that electrodes 250 can be located at any suitable location within EST 140. In any event, electrodes 250 are enabled to selectively excite ions of interest, for example by applying an excitation field E (depicted in FIG. 3) between electrodes 250 when ions of interest are oscillating proximal electrode 250; in embodiments where electrodes 250 comprises a pair of ring electrodes, electrodes 250 are enabled to selectively excite ions passing between them.

Figure 3:
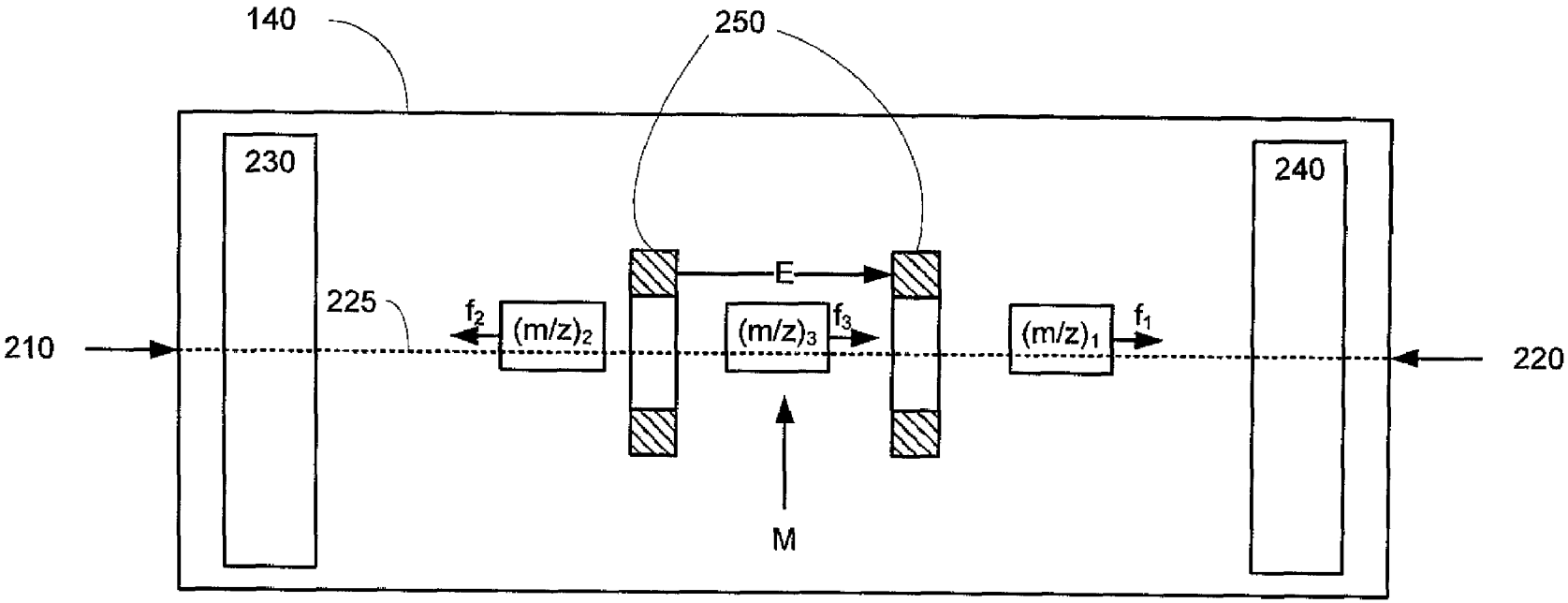
FIG. 3 depicts the electrostatic of FIG. 2 with bunches of ions oscillating therein, according to non-limiting embodiments.

EST 140 can further comprise any number of suitable electrodes (not depicted) for causing ions to oscillate between ion mirrors 230, 240 via the application of suitable static and time varying electric fields (e.g. including, but not limited to, RF (radio-frequency) and sinusoidal fields, etc.). In particular, ions of different mass-to-charge (m/z) ratios will oscillate with a unique period of oscillation (though not necessarily sinusoidally). Hence, once ions are admitted into EST 140, after a period of time, ions separate into bunches of ions of different (m/z) values as they oscillate. This is generally depicted in FIG. 3, which is substantially similar to FIG. 2, however with bunches of ions if different m/z values: $(m/z)_1$, $(m/z)_2$, and $(m/z)_3$, and hence each oscillating at respective different frequencies $f_1$, $f_2$, and $f_3$. In general, over time, ions tend to separate into bunches of a single, narrow range of mass-to-charge ratios, of greater than 10,000 mass resolution.

Ions introduced in to EST 140 are further understood to oscillate in the range of frequencies from 10 s to 100 s of kHz.

A bunch of ions of $(m/z)_1$ will pass a given point within EST 140, for example a midpoint M between electrodes 250, at times $t1_1$, $t1_2$, $t1_3$, . . . , where the difference between each successive time is constant (i.e. $t1_3-t1_2=t1_2-t1_1$). Bunches of ions of $(m/z)_2$ will pass the same given point M at times $t2_1$, $t2_2$, $t2_3$, . . . where the difference between each successive time is also a constant (i.e. $t2_3-t2_2=t2_2-t2_1$). Bunches of ions of $(m/z)_3$ will pass the same given point M at times $t3_1$, $t3_2$, $t3_3$, . . . where the difference between each successive time is constant (i.e. $t3_3-t3_2=t3_2-t3_1$). Furthermore, $t3_3-t3_2\neq t2_2-t2_1\neq t1_2-t1_1$ as each bunch of ions of $(m/z)_1$, $(m/z)_2$, and $(m/z)_3$, are oscillating at different frequencies $f_1$, $f_2$, and $f_3$. Hence, each bunch of ions of $(m/z)_1$, $(m/z)_2$, and $(m/z)_3$ will pass given point M at different times A bunch of ions of a given $(m/z)_n$ can then be selectively excited by applying excitation field E via electrodes 250, at particular times $tn_1$, $tn_2$, $tn_3$ . . . when the bunch of ions of the given $(m/z)_n$ are passing a given point M (e.g. ions of $(m/z)_3$ in FIG. 3), or are generally within the region between the two electrodes 250. Excitation field E can be at least one of generally sinusoidal, square or of any suitable shape that can be optimized for ejection efficiency. Better selection efficiency can be obtained if the spacing between electrodes 250 is relatively short, compared to the distance between ion mirrors 230 and 240. Furthermore, the frequency $f_n$ and time that the bunch of ions of $(m/z)_n$ passing the given point M can be determined by measuring the frequency of electric fields caused by the oscillation of the bunch of ions of (m/z)n within EST 140, for example as they pass through electrodes 250; a Fourier transform of the measured signal provides a frequency spectrum that can further be transformed into a mass spectrum. Furthermore, excitation field E can comprise an oscillating electric field along longitudinal axis 225 applied in phase with an oscillation of the given bunch of ions of $(m/z)_n$ along longitudinal axis 225.

In some embodiments, however, such an oscillating electric field can be applied in at least one of entrance end ion mirror 230 and exit end ion mirror 240. In these embodiments, electrodes 250 are not present in EST 140. For example, a small perturbation can be applied to the back of one or both ions mirrors 230, 240 in phase with a selected bunch of ions of mass $(m/z)_n$. Such a perturbation selectively energizes the selected bunch if ions such that the barrier field at exit end ion mirror 240 can be overcome.

Furthermore, in some embodiments, each of entrance end ion mirror 239 and exit end ion mirror 240 can be compensated to maintain timing and phase of oscillating ions when excited.

Figure 4:
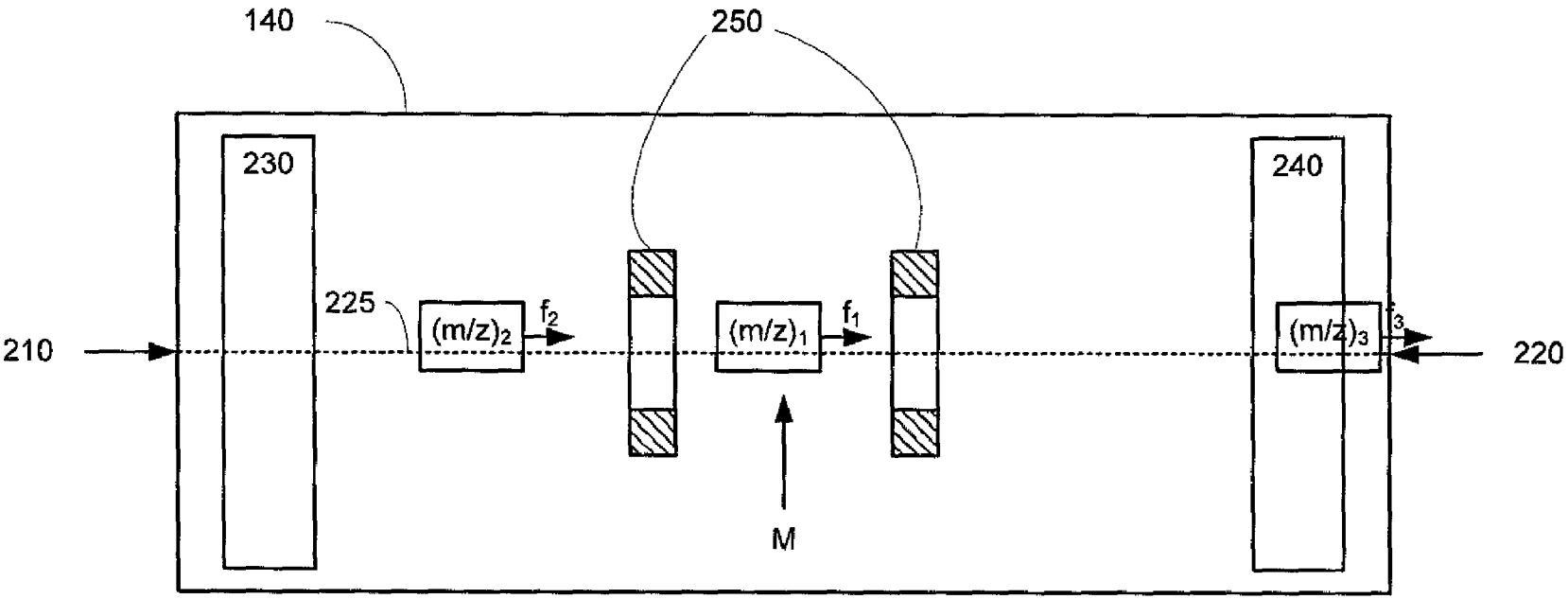
FIG. 4 depicts the electrostatic of FIG. 2 with a bunches of ions overcoming a barrier field at an exit end ion mirror, according to non-limiting embodiments.

In any event, a given bunch of ions of a given m/z value can be excited along longitudinal axis 225 until at least a portion of the given bunch overcomes a barrier field at exit end ion mirror 240, the given bunch of ions thereby exiting EST 140, leaving behind remaining ions in EST 140. Such a situation is depicted in FIG. 4 (substantially similar to FIG. 3), where the bunch of ions of $(m/z)_3$ has been excited by application of excitation field E between electrodes 250 each time the bunch of ions of $(m/z)_3$ passes given point M. Once the bunch of ions of $(m/z)_3$ is excited to a given energy, the barrier field at end ion mirror 240 is overcome, and the bunch of ions $(m/z)_3$ exits EST 140, leaving behind bunches of ions of $(m/z)_1$, $(m/z)_2$. Hence, ions of a single, narrow range of mass-to-charge ratios can be selected and analyzed, with a mass resolutions of greater than 10,000. In some embodiments, only a portion a given bunch of ions of $(m/z)_n$ overcomes the barrier field at exit end ion mirror 240.

In any event, the given bunch of ions of $(m/z)_n$ (or portion thereof) can then be transmitted to fragmentation module 150 for fragmentation such that fragmented respective product ions are produced. In some embodiments, the given bunch of ions of $(m/z)_n$ are decelerated prior to fragmentation in order to control and select the energy of fragmentation. In these embodiments, decelerating can occur via at least one of a decelerating lens (not depicted), a decelerating electric field (applied via a decelerating field apparatus, not depicted), and an ion focussing field (applied via an ion focussing field apparatus, not depicted), between EST 140 and fragmentation module 150. In some embodiments, fragmentation module 150 can be operated in alternating low energy fragmentation and high energy fragmentation modes to first identify precursor (i.e. parent) ions and associated respective product (i.e. child) ions of each mass range.

Once fragmented, product ions are transferred to mass analyzer 160 for analysis and production of product ion spectra. Mass analyzer 160 can comprise any suitable mass spectrometer module including, but not limited to, a time of flight (TOF) mass spectrometry module, a quadrupole mass spectrometry module and the like.

Once the given bunch of ions of $(m/z)_n$ has been fragmented and analyzed, successive bunches of ions of $(m/z)_m$, can be excited in EST 140 in a similar manner, each fragmented and analyzed in turn. Thus ions in EST 140 are not discarded and sample is used efficiently.

Figure 5:
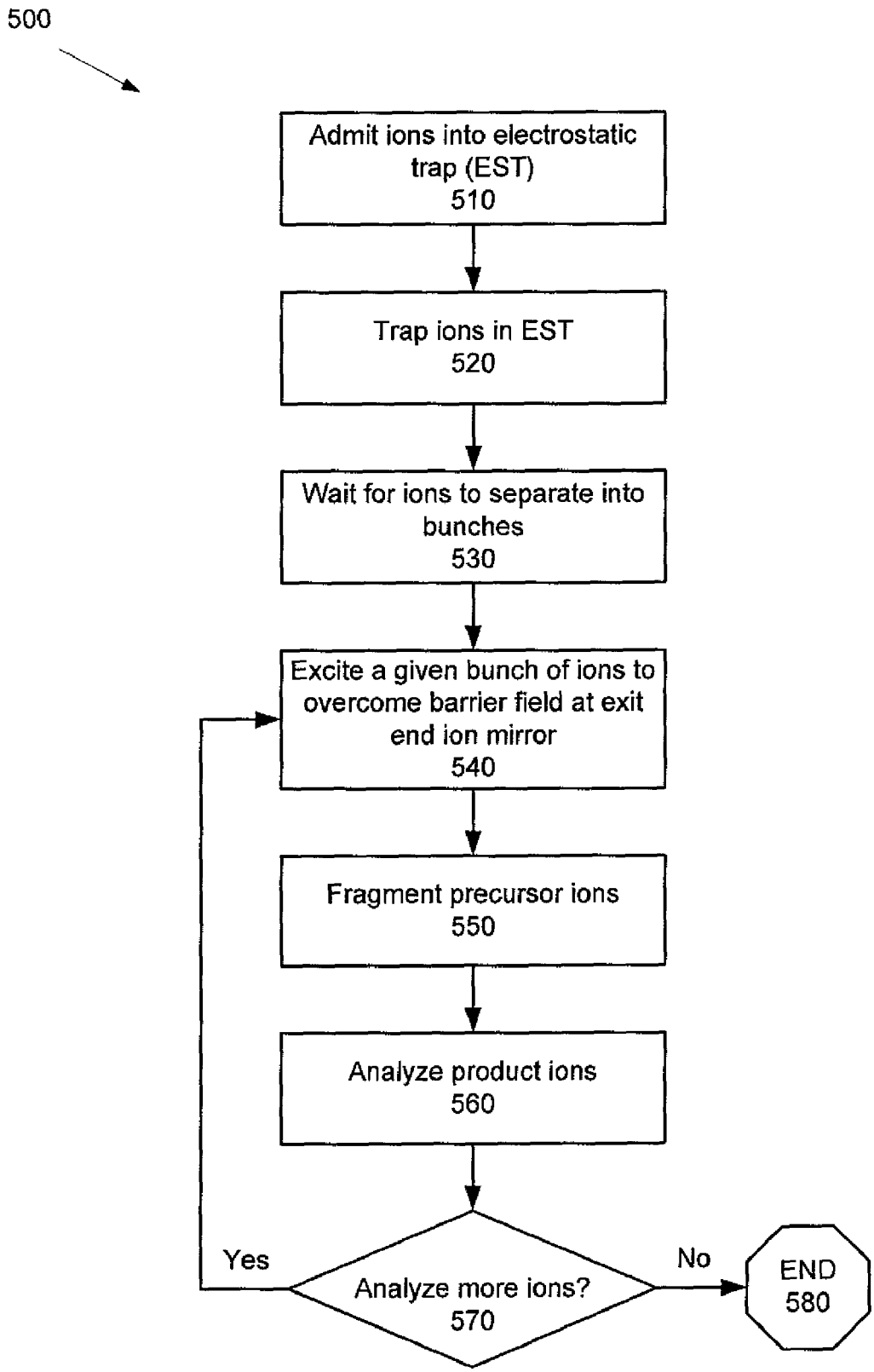
FIG. 5 depicts a method for performing high resolution mass spectrometry, according to non-limiting embodiments.

Attention is now directed to FIG. 5 which depicts a method 500 for operating a mass spectrometer comprising an electrostatic trap. In order to assist in the explanation of the method 500, it will be assumed that the method 500 is performed using mass spectrometer 100. Furthermore, the following discussion of the method 500 will lead to a further understanding of mass spectrometer 100 and its various components. However, it is to be understood that mass spectrometer 100 and/or method 500 can be varied, and need not work exactly as discussed herein in conjunction with each other, and that such variations are within the scope of present embodiments.

At step 510 ions are admitted into EST 140 via entrance end 210. It is understood that ions are produced in ion source 120 and are transferred to EST 140 via ion optics 130.

At step 520 ions are trapped in EST 140, ions oscillating between entrance end ion mirror 230 and exit end ion mirror 249 along longitudinal axis 225 by application of suitable electric fields in ion mirrors 230, 240 and between ion mirrors 230, 240.

At step 530, ions separate into bunches of ions of different m/z values via the oscillating, as described above. In particular, a suitable period of time elapses such that ions separate into bunches of different m/z values due to the respective different oscillation frequencies.

At step 540, a given bunch of ions of a given m/z value are excited along longitudinal axis 225 until at least a portion of the given bunch overcomes a barrier field at exit end ion mirror 240, thereby exiting EST 140, leaving behind remaining ions in EST 140. Excitation occurs via application of excitation field E between electrodes 250 when the given bunch of ions passes given point M. Application of excitation field E can occur when the given bunch of ions is travelling in either direction between ion mirrors 230, 240. Furthermore, the remaining ions in EST 140 continue to oscillate between ion mirrors 230, 240. Alternatively, a perturbation can be applied at one or both of ion mirrors 230, 240, as described above, to excite the given bunch of ions of the given m/z.

In some embodiments, at step 550, once the given bunch of ions have excited EST 140, the given bunch of ions can be fragmented in fragmentation module 150 prior to analysis of at least a portion of the given bunch ions via mass analyzer 160, at step 560.

At step 570 it can be determined if more ions in EST 140 are to be selected and analyzed. If not, method 500 ends at step 580. Ions remaining in EST 140 can be flushed and ions of a new sample can be introduced into EST 140, as desired.

However, if it is determined at step 570 that more ions in EST 140 are to be selected and analyzed, steps 540 through 560 are repeated such that a second given bunch of remaining ions of a second given m/z value are excited along longitudinal axis 225 until at least a portion of the second given bunch overcomes the barrier field at exit end ion mirror 240, thereby exiting EST 140, leaving behind further remaining ions in EST 140. The second given bunch can then be fragmented (if desired) and analyzing said mass analyzer 160. Steps 540 to 570 can be repeated any suitable number of times until ions no ions of interest remain in EST 140.

In general, then, by operating EST 140 in a mode where a period of time elapses to allow ions to oscillate into bunches if ions of different (m/z), and then selectively excited a bunch of ions of interest until it overcomes the barrier field at exit end ion mirror 240, very high mass resolutions can be achieved. Furthermore, as ions remaining in EST 140 are not discarded, at least a second bunch of ions can be similarly excited, transferred from EST 140 and analyzed, such that ions from samples of limited quantities are not wasted.

Those skilled in the art will appreciate that in some embodiments, the functionality of mass spectrometer 100 can be implemented using pre-programmed hardware or firmware elements (e.g., application specific integrated circuits (ASICs), electrically erasable programmable read-only memories (EEPROMs), etc.), or other related components. In other embodiments, the functionality of mass spectrometer 100 can be achieved using a computing apparatus that has access to a code memory (not shown) which stores computer-readable program code for operation of the computing apparatus. The computer-readable program code could be stored on a computer readable storage medium which is fixed, tangible and readable directly by these components, (e.g., removable diskette, CD-ROM, ROM, fixed disk, USB drive). Alternatively, the computer-readable program code could be stored remotely but transmittable to these components via a modem or other interface device connected to a network (including, without limitation, the Internet) over a transmission medium. The transmission medium can be either a non-wireless medium (e.g., optical and/or digital and/or analog communications lines) or a wireless medium (e.g., microwave, infrared, free-space optical or other transmission schemes) or a combination thereof.

Persons skilled in the art will appreciate that there are yet more alternative implementations and modifications possible for implementing the embodiments, and that the above implementations and examples are only illustrations of one or more embodiments. The scope, therefore, is only to be limited by the claims appended hereto.

What is claimed is:

1. A method of operating a mass spectrometer comprising an electrostatic trap, said electrostatic trap comprising an entrance end, an exit end, an entrance end ion mirror and an exit end ion mirror, a central field-free region, and a longitudinal axis, said mass spectrometer further comprising a mass analyzer enabled to receive ions from said exit end, the method comprising:

admitting ions into said electrostatic trap via said entrance end;

trapping ions in said electrostatic trap, said ions oscillating between said entrance end ion mirror and said exit end ion mirror along said longitudinal axis;

waiting for said ions to separate into bunches of ions of different m/z values via said oscillating;

exciting a given bunch of ions of a given m/z value along said longitudinal axis until at least a portion of said given bunch overcomes a barrier field at said exit end ion mirror, thereby exiting said electrostatic trap, leaving behind remaining ions in said electrostatic trap; and analyzing at least a portion of said given bunch via said mass analyzer.

2. The method of claim 1, wherein said exciting said subset of said ions comprises applying an oscillating electric field along said longitudinal axis in phase with an oscillation of said given bunch along said longitudinal axis.

3. The method of claim 2, wherein said oscillating electric field is applied between a pair of at least one of ring electrodes, grid electrodes and aperture containing plate electrodes, located in said central field-free region.

4. The method of claim 2, wherein said oscillating electric field is applied in at least one of said entrance end ion mirror and said exit end ion mirror.

5. The method of claim 1, further comprising compensating each said entrance end ion mirror and said exit end ion mirror to maintain timing and phase of said oscillating during said exciting.

6. The method of claim 1, further comprising fragmenting at least a portion of said given bunch in a fragmentation module prior to said analyzing.

7. The method of claim 6, further comprising decelerating said given bunch prior to said fragmenting.

8. The method of claim 7, wherein said decelerating occurs via at least one of a decelerating lens, a decelerating electric field, and an ion focussing field.

9. The method of claim 1, further comprising: exciting a second given bunch of said remaining ions of a second given m/z value along said longitudinal axis until at least a portion of said second given bunch overcomes said barrier field at said exit end ion mirror, thereby exiting said electrostatic trap, leaving behind further remaining ions in said electrostatic trap; and analyzing at least a portion of said second given bunch via said mass analyzer.

10. A mass spectrometer comprising:

an electrostatic trap comprising an entrance end, an exit end, an entrance end ion mirror and an exit end ion mirror, a central field-free region, and a longitudinal axis, said electrostatic trap enabled to:

admit ions therein via said entrance end;

trap ions therein such that said ions oscillate between said entrance end ion mirror and said exit end ion mirror along said longitudinal axis;

wait for said ions to separate into bunches of ions of different m/z values via said oscillating; and excite a given bunch of ions of a given m/z value along said longitudinal axis until at least a portion of said given bunch overcomes a barrier field at said exit end ion mirror, thereby exiting said electrostatic trap, leaving behind remaining ions in said electrostatic trap; and a mass analyzer enabled to receive ions from said exit end and analyze at least a portion of said given bunch.

11. The mass spectrometer of claim 10, wherein to excite said subset of said ions, said electrostatic trap is further enabled to apply an oscillating electric field along said longitudinal axis in phase with an oscillation of said given bunch along said longitudinal axis.

12. The mass spectrometer of claim 11, wherein said electrostatic trap further comprises a pair of at least one of ring electrodes, grid electrodes and aperture containing plate electrodes, located in said central field-free region, said oscillating electric field applied there between.

13. The mass spectrometer of claim 11, wherein said electrostatic trap further is further enabled to apply said oscillating electric field in at least one of said entrance end ion mirror and said exit end ion mirror.

14. The mass spectrometer of claim 10, wherein said electrostatic trap further is further enabled to compensate each said entrance end ion mirror and said exit end ion mirror to maintain timing and phase of said oscillating when said given bunch of ions is excited.

15. The mass spectrometer of claim 10, further comprising a fragmentation module enabled to fragment at least a portion of said given bunch prior to said given bunch being analyzes at said mass analyzer.

16. The mass spectrometer of claim 15, further enabled to decelerate said given bunch prior to fragmenting said given bunch.

17. The mass spectrometer of claim 16, further comprising at least one of a decelerating lens, a decelerating electric field apparatus, and an ion focussing field apparatus for decelerating said given bunch prior to said fragmenting said given bunch.

18. The mass spectrometer of claim 10, said electrostatic trap further enabled to: excite a second given bunch of said remaining ions of a second given m/z value along said longitudinal axis until at least a portion of said second given bunch overcomes said barrier field at said exit end ion mirror, thereby exiting said electrostatic trap, leaving behind further remaining ions in said electrostatic trap at least a portion of said second given bunch analyzed via said mass analyzer.

* * * * *